US009795993B2

(12) United States Patent
Beck et al.

(10) Patent No.: US 9,795,993 B2
(45) Date of Patent: Oct. 24, 2017

(54) SCREENING FOR CLASSIFYING A MATERIAL

(71) Applicant: Lumsden Corporation, Lancaster, PA (US)

(72) Inventors: Jeffrey L. Beck, Honey Brook, PA (US); Myron Henry Wardell, Lititz, PA (US); Boyd K. Knepp, Lancaster, PA (US)

(73) Assignee: Lumsden Corporation, Lancaster, PA (US)

( * ) Notice: Subject to any disclaimer, the term of this patent is extended or adjusted under 35 U.S.C. 154(b) by 0 days.

(21) Appl. No.: 14/192,117

(22) Filed: Feb. 27, 2014

(65) Prior Publication Data

US 2014/0231316 A1 Aug. 21, 2014

Related U.S. Application Data

(63) Continuation-in-part of application No. 13/137,834, filed on Sep. 15, 2011, now Pat. No. 8,919,568.

(51) Int. Cl.
*B07B 1/49* (2006.01)
*B07B 1/46* (2006.01)

(52) U.S. Cl.
CPC ..... *B07B 1/4681* (2013.01); *B07B 1/4672* (2013.01)

(58) Field of Classification Search
CPC ..... B07B 1/46; B07B 1/4618; B07B 1/4609; B07B 1/4663; B07B 1/4681
USPC ..... 209/392, 400, 401, 403
See application file for complete search history.

(56) References Cited

U.S. PATENT DOCUMENTS

| | | | | |
|---|---|---|---|---|
| 1,459,845 A | | 6/1923 | Mitchell | |
| 2,062,773 A | * | 12/1936 | Weber | 139/425 A |
| 2,132,252 A | * | 10/1938 | Weber | 139/425 A |
| 2,604,989 A | * | 7/1952 | Warhol | 209/401 |
| 2,723,032 A | | 11/1955 | Gisler et al. | |

(Continued)

FOREIGN PATENT DOCUMENTS

JP 6-936 * 1/1994

OTHER PUBLICATIONS

Clean Thru, Buffalo Wire Works, Mar. 2005, 2 pages.

(Continued)

*Primary Examiner* — Thomas Morrison
(74) *Attorney, Agent, or Firm* — Merek, Blackmon & Voorhees, LLC

(57) ABSTRACT

A screening or screen for use in classifying material. The screening includes a plurality of warp screening elements. Preferably, the plurality of warp screening elements is a plurality of warp wires. The plurality of warp screening elements includes a first warp screening element having a plurality of horizontal undulations. The plurality of warp screening elements further includes a second warp screening element. Preferably, one of the first warp screening element and the second warp screening element is a shaped wire having two substantially flat sidewalls. At least one retaining member is operably associated with the plurality of warp screening elements to form an integral screen segment having a plurality of openings for permitting material to be classified to pass through the openings. The first warp screening element has a cross-sectional height or shape different from the cross-sectional height or shape of the second warp screening element.

19 Claims, 2 Drawing Sheets

(56) References Cited

U.S. PATENT DOCUMENTS

| | | | | |
|---|---|---|---|---|
| 3,716,138 | A | 2/1973 | Lumsden | |
| D238,776 | S * | 2/1976 | Howells | D5/2 |
| D239,827 | S * | 5/1976 | Howells | D25/142 |
| 4,024,612 | A | 5/1977 | Contractor et al. | |
| 4,120,785 | A * | 10/1978 | Kanamori et al. | 209/401 |
| 4,396,685 | A * | 8/1983 | Jury | 428/594 |
| 4,491,517 | A | 1/1985 | Janovac | |
| 4,923,583 | A * | 5/1990 | Woodard et al. | 204/284 |
| 5,716,718 | A * | 2/1998 | Lai | 428/577 |
| 6,510,947 | B1 | 1/2003 | Schulte et al. | |
| 7,581,569 | B2 * | 9/2009 | Beck | 139/425 R |
| 7,682,996 | B2 | 3/2010 | Carr | |
| 7,815,053 | B2 | 10/2010 | Knepp | |
| 7,980,392 | B2 | 7/2011 | Larson et al. | |
| 8,087,134 | B2 * | 1/2012 | Morley | 29/6.1 |
| 8,919,568 | B2 | 12/2014 | Beck et al. | |
| 2008/0148568 | A1 * | 6/2008 | Morley | 29/890.03 |
| 2009/0294334 | A1 | 12/2009 | Knepp | |
| 2011/0220555 | A1 * | 9/2011 | Steadman | 209/401 |
| 2013/0068668 | A1 | 3/2013 | Beck et al. | |
| 2015/0021240 | A1 | 1/2015 | Wardell et al. | |
| 2016/0038977 | A1 | 2/2016 | Knepp et al. | |

OTHER PUBLICATIONS

Clean Slot, Buffalo Wire Works, at least as early as Jul. 18, 2012, 2 pages.

Office Action dated Sep. 24, 2015 issued in U.S. Appl. No. 13/946,207, filed Jul. 19, 2013 pending.

Amendment filed Mar. 24, 2016 in U.S. Appl. No. 13/946,207, filed Jul. 19, 2013 pending.

Hy Pro screen as described in the remarks section of Amendment filed on Mar. 24, 2016 in U.S. Appl. No. 13/946,207, filed Jul. 19, 2013 pending.

* cited by examiner

SCREENING FOR CLASSIFYING A MATERIAL

RELATED APPLICATION

This application is a continuation-in-part of and claims priority from U.S. patent application Ser. No. 13/137,834 filed on Sep. 15, 2011 and entitled, "Screening for Classifying Material." The entire contents of U.S. patent application Ser. No. 13/137,834 are incorporated herein by reference.

FIELD OF THE INVENTION

The present invention is directed to a screening for classifying a material. More particularly, a preferred embodiment of the present invention is directed to a screening used in a shaker or vibrating screen apparatus that classifies material flowing through one or more screenings.

BACKGROUND OF THE INVENTION

One or more screenings or screens have been used in shaker or vibrating screen apparatus to size material passing through the screens. Known screens/screenings typically consist of a plurality of warp screening elements and a plurality of retaining members operably associated with the warp screening elements to form an integral screen segment having a plurality of openings for permitting suitably sized material to pass through the screen. The warp screening elements can be wires or plastic members. The openings can be square, triangular, rectangular or diamond shaped. Alternatively, the screen can be formed as a long slot screen where the warp screening elements are maintained in spaced parallel relation by retaining members arranged in groups of three at spaced intervals along the length of the warp screening elements. The retaining members can be weft wires.

Screen design is problematic as numerous factors can adversely impact the performance and longevity of the screen. For example, the through put of the screen is extremely important as a screen which does not allow for efficient sizing or grading of material will not meet commercial demands although the screen can satisfactorily classify material. Another significant factor is the ability of the screen to maintain the desired opening size to ensure that material passing through the screen can be accurately classified. A further significant factor is the ability of the screen to avoid blinding. Specifically, where one or more openings in the screen become partially or completely obstructed by material or foreign matter, the performance of the screen greatly deteriorates. Moreover, the longevity of the screen is an important factor to the commercial success of the screen.

Conventional screens have been unable to address one or more of the aforementioned factors to the detriment of the screen and it commercial success.

OBJECTS AND SUMMARY OF THE INVENTION

An object of the present invention is to provide a novel and unobvious screening.

Another object of a preferred embodiment of the present invention is to provide a screen that is designed to be self-cleaning to avoid blinding of the screen.

A further object of a preferred embodiment of the present invention is to enhance the action of the material impacting the surface of the screen to maximize through put.

Yet another object of a preferred embodiment of the present invention is to provide a screening that has warp screening elements that are designed to promote self-cleaning of the screen and avoid blinding of the screen.

Still another object of a preferred embodiment of the present invention is to provide a screening that has warp screening elements with differing cross-sectional shapes to promote self-cleaning of the screen, avoid blinding of the screen and improve through put.

Yet still another object of a preferred embodiment of the present invention is to provide a screening that has a first set of warp screening elements and a second set of warp screening elements where each of the first set of warp screening elements and each of the second set of warp screening elements are formed from the same size diameter of wire and where each of the first set of warp screening elements have a height different from the height of each of wires in the second set of warp screening element to promote self-cleaning, avoid blinding and improve through put with minimal or no adverse effect on the longevity of the wire screen.

It must be understood that no one embodiment of the present invention need include all of the aforementioned objects of the present invention. Rather, a given embodiment may include one or none of the aforementioned objects. Accordingly, these objects are not to be used to limit the scope of the claims of the present invention.

In summary, a preferred embodiment of the present invention is directed to a screening for use in classifying material flowing through the screening. The screen or screening includes a plurality of warp screening elements. The plurality of warp screening elements includes a first warp screening element having a plurality of horizontal undulations. The plurality of warp screening elements further includes a second warp screening element. One of the first warp screening element and the second warp screening element is a shaped wire having two substantially flat sidewalls. The screening or screen further includes at least one retaining member operably associated with the plurality of warp screening elements to form an integral screen segment having a plurality of openings for permitting material to be classified to pass through the openings. The first warp screening element has a first cross-sectional height. The second warp screening element has a second cross-sectional height. The first cross-sectional height is different from the second cross-sectional height.

Another preferred embodiment of the present invention is directed to a screening for use in classifying material flowing through the screening. The screen or screening includes a plurality of warp screening elements. The plurality of warp screening elements includes a first warp screening element. The plurality of warp screening elements further includes a second warp screening element. The first warp screening element has a cross-sectional shape different from a cross-sectional shape of the second warp screening element. The first warp screening element has a first uppermost surface. The second warp screening element has a second uppermost surface. The first uppermost surface is offset vertically from the second uppermost surface. The screen or screening further includes at least one retaining member operably associated with the plurality of warp screening elements to form an integral screen segment having a plurality of openings for permitting material to be classified to pass through the openings.

A further preferred embodiment of the present invention is directed to a screening for use in classifying material flowing through the screening. The screen or screening includes a plurality of warp screening elements. The plurality of warp screening elements includes a first set of warp wires. Each warp wire in the first set of warps wires has a plurality of horizontal undulations. The plurality of warp screening elements further includes a second set of straight warp wires. At least one retaining member is operably associated with the plurality of warp screening elements to form an integral screen segment having a plurality of openings for permitting material to be classified to pass through the openings. Each of the plurality of openings is formed at least in part by one wire from the first set of warp wires and one wire from the second set of warp wires. Each wire in the first set of warp wires has a cross-sectional height greater than each wire in the second set of warp wires.

DETAILED DESCRIPTION OF THE PREFERRED EMBODIMENTS OF THE INVENTION

The preferred forms of the invention will now be described with reference to FIGS. 1-3. The appended claims are not limited to the preferred forms and no term and/or phrase used herein is to be given a meaning other than its ordinary meaning unless it is expressly stated that the term and/or phrase shall have a special meaning.

FIGS. 1-2

Figure 1:
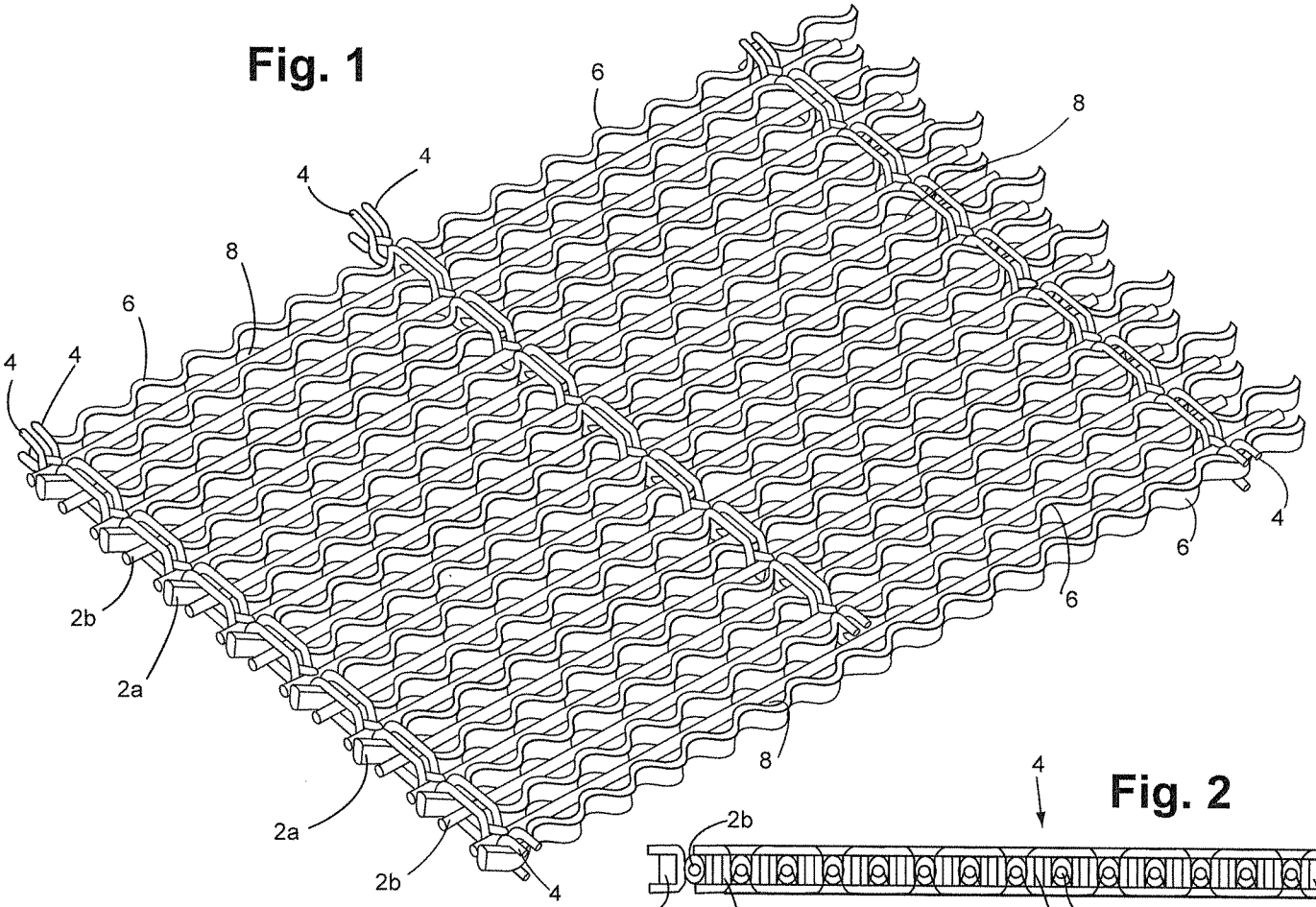
FIG. 1 is a perspective view of a portion of an integral woven wire screening or screen formed in accordance with a preferred embodiment of the present invention.
Figure 2:
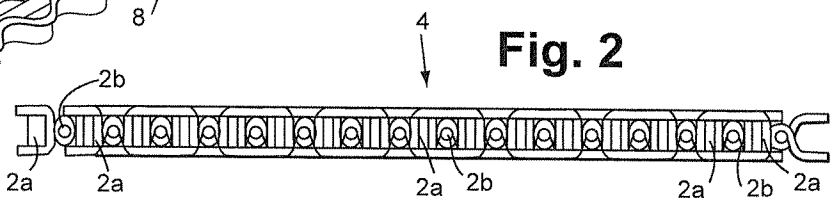
FIG. 2 is an elevational view of a portion of the left end of the screening illustrated in FIG. 1.

Referring to FIGS. 1 and 2, a portion of an integral woven wire screening or screen A formed in accordance with a preferred embodiment of the present invention is illustrated in one of many possible configurations. It will be readily appreciated that the size of screen A can be varied as desired.

Screen A includes a plurality of interwoven warp screening elements 2 and weft screening elements 4. The warp screening elements 2 are generally oriented perpendicular to the direction of flow of material on the screen surface formed by the uppermost portions of the warp screening elements. However, the warp screening elements 2 can be oriented in any desired manner including but not limited to parallel to the direction of flow of material over the screening surface. Preferably, the weft screening elements 4 are grouped in three or more wires at spaced intervals along the length of the warp screening elements 2 to maintain the warp screening elements 2 in a desired position. The spacing of the groups of weft screening elements 4 may be varied as desired. The weft screening elements 4 may be coated with a protective material (e.g., polyurethane) to prolong the life of the weft screening elements 4. In the most preferred form of this embodiment of the invention, the warp and weft screening elements are formed from wires of standard wire size. Standard wire sizes are identified in column 4 of U.S. Pat. No. 3,716,138. Wire sizes as used herein refer to standard wire sizes. While the warp and weft screening elements are preferably formed from wires, it will be readily appreciated that the warp and weft screening elements can be made from any suitable material including but not limited to non-metallic materials (e.g., polyurethane).

The warp screening elements 2 preferably include a first group of warp screening elements having warp wires 2*a* and a second group of warp screening elements having warp wires 2*b*.

Each of the warp wires 2*a* preferably include a plurality of horizontal undulations 6 along the length of the of the warp wires 2*a*. The horizontal undulations 6 may be formed by crimping or any other suitable process. Horizontal undulations as used herein refer to undulations that extend along the screening surface. It should be noted that screen A typically is bowed or curved when in use in a shaker or vibrating screen apparatus. However, it should be appreciated that the screen A may be planar.

As seen in FIG. 1, every other one of the warp wires 2*a* is preferably inverted about 180 degrees with respect to the adjacent one of the warp wires 2*a*. Each of the warp wires 2*b* preferably is a straight wire. The warp screening elements 2 are disposed such that the warp wires 2*a* and the warp wires 2*b* alternate across the width of the screen A. Hence, each opening 8 in the screen A is formed by a portion of the corresponding warp wire 2*a* and the corresponding warp wire 2*b*. The openings 8 preferably have a substantially triangular shape.

In the most preferred embodiment of the present invention, each warp wire 2*a* and each warp wire 2*b* are formed from the same size diameter wire. As seen in FIGS. 1 and 2, each warp wire 2*a* is a shaped wire, i.e., warp wires 2*a* each have two substantially flat vertically extending sidewalls. Shaped warp wires 2*a* may be formed by passing a non-shaped wire having a circular cross-section through oppositely disposed rollers. The rollers form the substantially flat vertical sidewalls in the warp wires 2*a*. This process results in a shaped warp wire 2*a* having a height greater than the original diameter of the wire prior to shaping and a width less than the original diameter of the wire prior to shaping.

Preferably, each warp wire 2*b* is a non-shaped wire having a circular cross-section. Hence, the non-shaped warp wires 2*b* have a height equal to the original diameter of the wire used to form shaped warp wire 2*a* prior to shaping which is less than the height of the shaped warp wire 2*a*. Therefore, the uppermost portion of each non-shaped warp wire 2*b* is disposed below the uppermost portion of the adjacent shaped warp wires 2*a*. This configuration creates a screen that has an irregular surface area (i.e., varying heights) that significantly improves the action of the material when impacting the irregular surface area of the screen increasing through put and thereby improving the overall efficiency of the screen. Further, because shaped warp wires 2*a* are shaped differently from non-shaped warp wires 2*b*, warp wires 2*a* will move differently than non-shaped warp wires 2*b* creating relative motion between the shaped warp wires 2*a* and the non-shaped warp wires 2*b* thereby preventing blinding of the screen, i.e., screen A will be self-cleaning.

Because shaped warp wires 2*a* and non-shaped warp wires 2*b* are formed from the same size diameter wire in the most preferred embodiment, the improved through put and self-cleaning nature of the screen is achieved without sacrificing wire strength. It is to be noted that the present invention is not limited to the most preferred form and as such different size wires may be used.

FIG. 3

Figure 3:
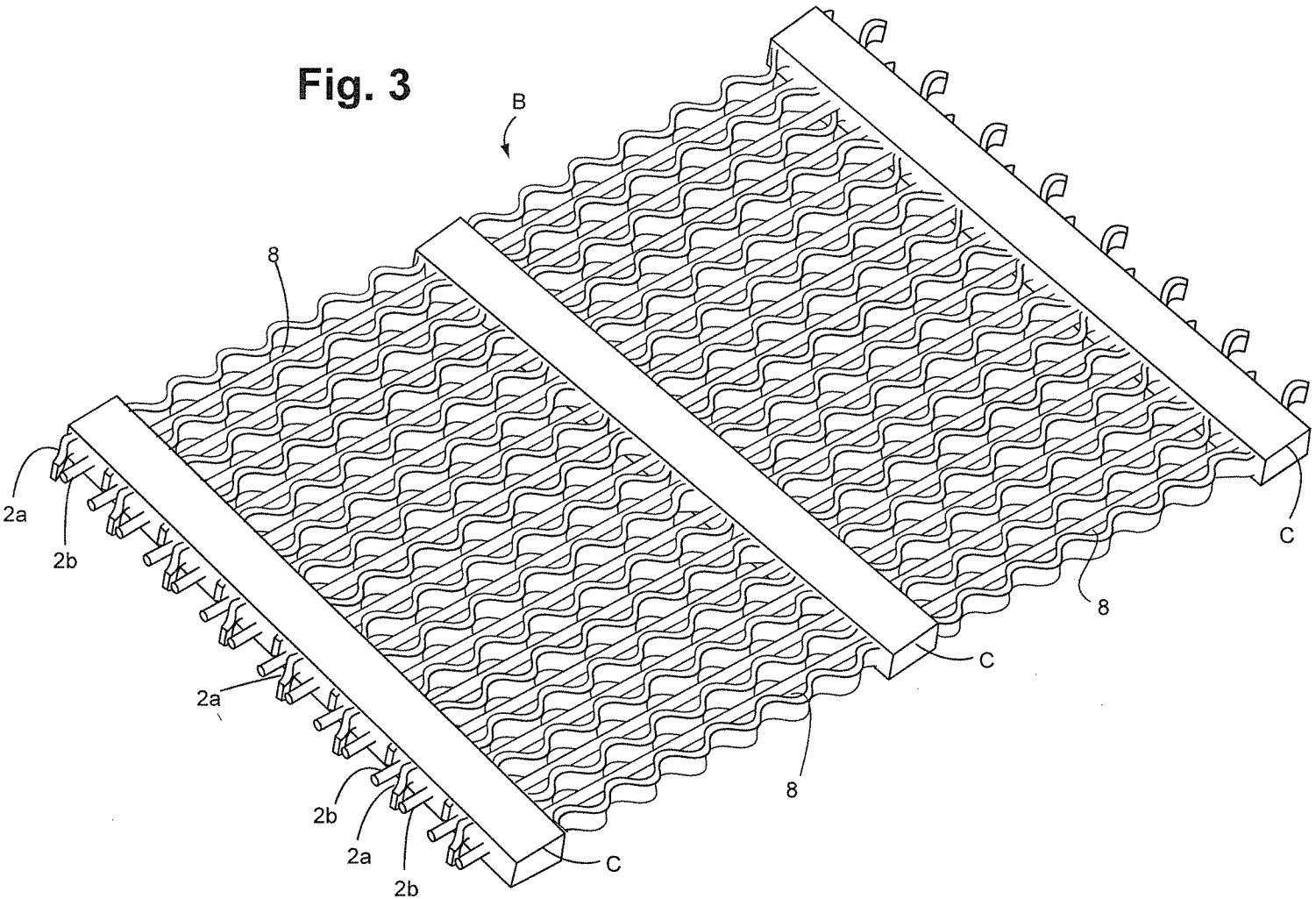
FIG. 3 a perspective view of a portion of an integral woven wire screening or screen formed in accordance with another preferred embodiment of the present invention.

Referring to FIG. 3, a portion of an integral woven wire screening or screen B formed in accordance with another preferred embodiment of the present invention is illustrated in one of many possible configurations. It will be readily appreciated that the size of screen B can be varied as desired.

Screen B is similar to screen A and includes the exact same warp wires 2*a* and 2*b*. The only difference is that Screen B uses non-metallic strips C instead of weft wires 4. Alternatively, metallic binding elements other than wires could be used in place of the strips C as the binding elements.

While this invention has been described as having a preferred design, it is understood that the preferred design can be further modified or adapted following in general the principles of the invention and including but not limited to such departures from the present invention as come within the known or customary practice in the art to which the invention pertains. The claims are not limited to the preferred embodiment and have been written to preclude such a narrow construction using the principles of claim differentiation.

We claim:

1. A screening for use in classifying material flowing through said screening, said screening comprising:

(a) a plurality of warp screening elements, said plurality of warp screening elements includes a first warp screening element having a plurality of horizontal undulations, said plurality of warp screening elements further including a second warp screening element, one of said first warp screening element and said second warp screening element is a shaped wire having two substantially flat sidewalls, said first warp screening element being configured to move relative to said second warp screening element during use of the screening to classify material flowing through said screening;

(b) at least one retaining member operably associated with said plurality of warp screening elements to form an integral screen segment having a plurality of openings for permitting material to be classified to pass through said openings, said first warp screening element and said second warp screening element each having a length greater than a combined length of two of said plurality of openings; and, (c) said first warp screening element having a first cross-sectional height, said second warp screening element having a second cross-sectional height, said first cross-sectional height is different from said second cross-sectional height and wherein said first warp screening element and said second warp screening element each have a solid cross-section.

2. A screening as set forth in claim 1, wherein:

(a) said first warp screening element and said second warp screening element are formed from the same size wire.

3. A screening as set forth in claim 1, wherein:

(a) said second warp screening element is a straight wire.

4. A screening as set forth in claim 3, wherein:

(a) said first warp screening element is a shaped wire having two substantially flat sidewalls.

5. A screening as set forth in claim 4, wherein:

(a) said first cross-sectional height is greater than said second cross-sectional height.

6. A screening as set forth in claim 1, wherein:

(a) said at least one retaining member includes a plurality of weft wires interwoven with said plurality of warp screening elements to form the integral screen segment.

7. A screening as set forth in claim 1, wherein:

(a) said at least one retaining member includes a plurality of non-metallic retaining strips.

8. A screening for use in classifying material flowing through said screening, said screening comprising:

(a) a plurality of warp screening elements, said plurality of warp screening elements includes a first warp screening element, said plurality of warp screening elements further including a second warp screening element, said first warp screening element having a cross-sectional shape different from a cross-sectional shape of said second warp screening element and wherein said first warp screening element and said second warp screening element each have a solid cross-section;

(b) said first warp screening element having a first uppermost surface, said second warp screening element having a second uppermost surface, said first uppermost surface is offset vertically from said second uppermost surface; and, (c) a first retaining member and a second retaining member, said first retaining member and said second retaining member being operably associated with said plurality of warp screening elements to form an integral screen segment having a plurality of openings for permitting material to be classified to pass through said openings, said first warp screening element including a first section disposed between said first retaining member and said second retaining member, said second warp screening element including a first section disposed between said first retaining member and said second retaining member, said first section of said first warp screening element and said first section of said second screening element forming two openings between said first retaining member and said second retaining member, no portion of said first section of said first warp screening element is fixed to any portion of said first section of said second warp screening element allowing said first section of said first warp screening element to move relative to said first section of said second warp screening element when the screening is used to classify material passing through the screening.

9. A screening as set forth in claim 8, wherein:

(a) said first warp screening element has a plurality of horizontal undulations and said second warp screening element is a straight wire.

10. A screening as set forth in claim 8, wherein:

(a) said first warp screening element is a shaped wire having two substantially flat sidewalls and said second warp screening element has a substantially circular cross-section.

11. A screening as set forth in claim 8, wherein:

(a) said first retaining member is formed at least in part from a non-metallic material.

12. A screening as set forth in claim 8, wherein:

(a) said first retaining member includes a plurality of weft wires.

13. A method of forming a screening for use in classifying material flowing through said screening including the steps of:

(a) providing a plurality of warp screening elements, said plurality of warp screening elements includes a first set of warp wires, each warp wire in said first set of warps wires having a plurality of horizontal undulations, said plurality of warp screening elements further including a second set of straight warp wires wherein each wire in the first set of warp wires and each wire in the second set of warp wires have a solid cross-section;

(b) providing at least one retaining member operably associated with said plurality of warp screening elements to form an integral screen segment having a plurality of openings for permitting material to be classified to pass through said openings, each of said plurality of openings being formed at least in part by one wire from said first set of warp wires and one wire from said second set of warp wires; and, (c) forming each wire in said first set of warp wires with a cross-sectional height greater than each wire in said second set of warp wires; and, (d) forming each wire in said first set of warp wires and each wire in said second set of warp wires from the same size of round wire.

14. A method as set forth in claim 13, wherein:

(a) each wire in said first set of warp wires is a shaped wire having two substantially flat sidewalls.

15. A method as set forth in 14, wherein:

(a) each wire in said second set of warp wires has a substantially circular cross-section.

16. A method as set forth in claim 13, wherein:

(a) said at least one retaining member includes a plurality of retaining strips formed from a non-metallic material.

17. A method as set forth in claim 16, wherein:

(a) said plurality of retaining strips are each formed from polyurethane.

18. A method as set forth in claim 13, wherein:

(a) said at least one retaining member includes a plurality of weft wires.

19. A method as set forth in claim 13, wherein:

(a) said first set of warps wires are configured to move relative to said second set of warp wires when the screening is in use.

* * * * *